US006372117B1

(12) United States Patent
Tamura

(10) Patent No.: US 6,372,117 B1
(45) Date of Patent: Apr. 16, 2002

(54) BRIGHT TIN-COPPER ALLOY ELECTROPLATING SOLUTION

(75) Inventor: Takaaki Tamura, Kanagawa (JP)

(73) Assignee: Nippon MacDermid Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/609,785

(22) Filed: Jul. 5, 2000

(30) Foreign Application Priority Data

Dec. 22, 1999 (JP) ..... 11-365405

(51) Int. Cl.[7] ..... C25D 3/58; C25D 3/60
(52) U.S. Cl. ..... 205/241; 205/254
(58) Field of Search ..... 205/254, 241

(56) References Cited

U.S. PATENT DOCUMENTS 6,183,545 B1 * 2/2001 Okuhama et al. ..... 106/1.18

FOREIGN PATENT DOCUMENTS

| | | | |
|---|---|---|---|
| JP | 57-60092 | A | 4/1982 |
| JP | 57-101687 | A | 6/1982 |
| JP | 58-9839 | A | 2/1983 |
| JP | 58-91181 | A | 5/1983 |
| JP | 59-4518 | A | 1/1984 |
| JP | 60-12435 | A | 4/1985 |
| JP | 4-13434 | A | 1/1992 |
| JP | 8-27590 | A | 1/1996 |
| JP | 8-27591 | A | 1/1996 |

* cited by examiner

*Primary Examiner*—Donald R. Valentine
*Assistant Examiner*—Thomas H. Parsons
(74) *Attorney, Agent, or Firm*—Carmody & Torrance LLP

(57) ABSTRACT

A tin/copper alloy electroplating solution capable of forming a bright plating film in a wide electric current density range is provided. The electroplating solution is a cyanide-free aqueous solution containing an organosulfonic acid, divalent tin and copper salts, as metal salts, of the organosulfonic acid, a dispersant, and a brightener.

6 Claims, No Drawings

BRIGHT TIN-COPPER ALLOY ELECTROPLATING SOLUTION

BACKGROUND OF THE INVENTION

Field of the Invention

The present invention relates to a bright tin/copper alloy electroplating solution.

DESCRIPTION OF THE RELATED ART

The pollution of soil and subterranean water has recently become an issue, which pollution is caused by acid-rain elution of lead from tin/lead alloy used in waste home electronic and electric appliances. This is because tin/lead alloy is widely used in mounting electronic components. Therefore, the development of a mounting solder alloy or solder plating not containing lead is keenly desired. As a plating method not giving rise to such a problem, tin/lead alloy plating is now considered promising. The tin/lead alloy plating has heretofore been used for decoration and the eutectic point of the same alloy is 227° C. Copper is less expensive than silver and bismuth the use of which is also under study at present. For example, in JP 8-27590A and JP 8-27591A there are disclosed bright tin/copper alloy plating solutions as copper alloy plating solutions. But these plating solutions involve a serious problem that they contain a cyanide and an alkali cyanide as essential components. Also, in JP 57-60092A, JP 57-101687A, JP 58-9839A, JP 58-91181A, JP 59-4518A, JP 60-12435A, and JP 4-13434A there are disclosed tin/copper plating solutions. With these tin/copper plating solutions, however, a bright plating film cannot be formed in a sufficiently wide electric current density range, thus involving the problem that the electric current density range capable of affording a bright plating film is narrow or a rough and matt film is apt to be deposited at a high electric current density. Thus, it is difficult to manufacture such tin/copper plating solutions on an industrial scale.

It is a principal object of the present invention to provide a cyanide-free tin/copper alloy plating solution capable of forming a tin/copper alloy plating film superior in smoothness and brightness in a wide electric current density range and capable of being put to practical use industrially.

SUMMARY OF THE INVENTION

Having made earnest studies, the present inventors found out that a good bright electrodeposition film could be obtained in a wide electric current density range by adding a dispersant and a brightener to an aqueous solution containing an organosulfonic acid, a divalent tin salt of the organosulfonic acid, and a divalent copper salt of the organosulfonic acid. On the basis of this finding we accomplished the present invention.

The present invention resides in a cyanide-free bright tin/copper alloy electroplating solution which comprises an aqueous solution containing an organosulfonic acid, a divalent tin salt of the organosulfonic acid, a divalent copper salt of the organosulfonic acid, a dispersant, and a brightener.

The present invention, in a preferred embodiment thereof, resides in the above bright tin/copper alloy electroplating solution wherein the dispersant comprises at least two members selected from the group consisting of polyoxyethylene alkyl phenyl ethers, polyoxyethylene alkyl ethers, and alkylene glycol alkyl ethers.

The present invention, in a further preferred embodiment thereof, resides in the above bright tin/copper alloy electroplating solution wherein the brightener comprises at least two members selected from the group consisting of aliphatic and aromatic aldehydes, aliphatic and aromatic ketones, and aliphatic carboxylic acids.

The present invention, in a still further preferred embodiment thereof, resides in the above bright tin/copper alloy electroplating solution further containing an antioxidant.

DETAILED DESCRIPTION OF THE INVENTION

The bright tin/copper alloy electroplating solution of the present invention will be described in detail hereinunder.

The organosulfonic acid used as the first essential component in the plating solution of the present invention can be represented by the following general formula (1):

$$R_1SO_3H \quad (1)$$

where $R_1$ stands for an alkyl or aryl group. In the general formula (1), the alkyl or aryl group as substituent $R_1$ preferably has 1 to 10 carbon atoms. Preferred examples of the organosulfonic acid are such alkanesulfonic acids as methanesulfonic acid, ethanesulfonic acid, propanesulfonic acid, 2-propanesulfonic acid, butanesulfonic acid, 2-butanesulfonic acid, pentanesulfonic acid, hexanesulfonic acid, and decanesulfonic acid, as well as such aromatic sulfonic acids as benzenesulfonic acid, toluenesulfonic acid, xylenesulfonic acid, and phenolsulfonic acid. One or more of the organosulfonic acids thus exemplified may be used in the plating solution of the present invention. But those with $R_1$ in the general formula (1) being alkyl are more preferable. These acids impart an electric conductivity to the plating solution and accelerate the dissolution of tin and copper salts into the plating solution or the dissolution of a plating anode into the plating solution.

The metal salts used as the second essential component in the plating solution of the present invention are a divalent tin salt of the organosulfonic acid and a divalent copper salt of the organosulfonic acid. These salts can each be prepared easily by reacting a divalent tin or copper salt or oxide with a desired organosulfonic acid. As the substances to be reacted with the organosulfonic acid, oxides of divalent tin and copper are preferred because they are effective in preventing an anionic pollution of the resulting metal salts. The metal salts added into the plating solution serve as a source of metal ions deposited on cathode. Tin is apt to be oxidized from divalent to tetravalent tin, so for the purpose of preventing this oxidation, such an antioxidant as catechol, resorcin, or hydroquinone, may be added into the plating solution.

The dispersant used as the third essential component in the plating solution of the present invention is not specially limited if only it is dissolved in the above basic solution. Particularly preferred are polyoxyethylene alkyl phenyl ethers, polyoxyethylene alkyl ethers, and alkylene glycol alkyl ethers. These compounds may be used each alone or in combination of two or more. Particularly, using two or more of them is preferred. As preferred examples are mentioned polyoxyethylene octyl phenyl ether, polyoxyethylene nonyl phenyl ether, polyoxyethylene dodecyl ether, polyoxyethylene alkyl ($C_{12}$~$C_6$) ether, propylene glycol methyl ether, dipropylene glycol methyl ether, and propylene glycol phenyl ether.

The dispersant not only functions to make a brightener easy to dissolve in the plating solution which brightener is difficult to dissolve in water, but also functions to lower the surface tension of the plating solution and thereby smooth the plating film surface and brighten its appearance. The amount of the dispersant to be used is usually in the range of 0.5 to 50 g/L, preferably 1 to 30 g/L, as a total concentration of one or more of those exemplified above in the plating solution.

As examples of the brightener used as the fourth essential component in the plating solution of the present invention, mention may be made of formaldehyde, acetaldehyde, paraldehyde, butylaldehyde, isobutylaldehyde, propionaldehyde, glyoxal, aldol, caproic aldehyde, benzaldehyde, veratraldehyde, anisaldehyde, salicylaldehyde, 1-naphthaldehyde, 2-naphthaldehyde, naphthalaldehyde, acetylacetone, benzylideneacetone, benzylideneacetylacetone, acetophenone, benzalacetone, acrylic acid, and methacrylic acid. These brighteners may each be used alone, but are preferably employed as a mixture of two or more. The concentration of the brightener in the plating solution is usually in the range of 0.01 to 20 g/L, preferably 0.1 to 10 g/L.

Into the plating solution of the present invention there may be added, for example, catechol, resorcin, hydroquinone, or pyrocatechol, as an antioxidant for suppressing the oxidation of tin. The concentration of the antioxidant in the plating solution is usually in the range of 0.1 to 20 g/L, preferably 0.2 to 10 g/L.

As plating work conditions using the bright tin/copper alloy electroplating solution of the invention, an appropriate electric current density is in the range of 0.5 to 20 A/dm$^2$ and an appropriate solution temperature is in the range of 10° to 30° C. In such a wide electric current density range it is possible to form a tin/copper alloy plating film having a good gloss and it becomes possible to carry out the plating work at a higher electric current density than in the prior art. This point, coupled with the point that the plating solution does not contain any cyanide, contributes to the improvement of the working efficiency.

According to the cyanide-free bright tin/copper alloy electroplating solution of the invention, a tin/copper alloy plating film having gloss and superior in both smoothness and macrothrowing power can be formed in a wide electric current density range. Thus, the bright tin/copper alloy electroplating solution of the invention is suitable for industrial application.

EXAMPLES

The present invention will be described below in more detail by way of working examples, but it is to be understood that the invention is not limited thereto. Plating appearance in each of the following examples was evaluated by Hull cell test.

Example 1 & Comparative Examples 1~2

There was prepared a plating solution containing 30 g/L of tin methanesulfonate (as $Sn^{2+}$), 0.1 g/L of copper methanesulfonate (as $Cu^{2+}$), 200 g/L of methanesulfonic acid, 10 g/L of polyoxyethylene dodecyl ether, 1.5 g/L of dipropylene glycol methyl ether, 0.5 g/L of formaldehyde, 0.2 g/L of salicylaldehyde, 0.2 g/L of acetylacetone, 0.3 g/L of acrylic acid, and 0.7 g/L of catechol. Using this plating solution, plating was carried out at an electric current of 2A for 5 minutes, and the appearance of the resultant plating film was evaluated in a comparative manner. By way of comparison there was prepared a plating solution not containing a brightener. Then, using this comparative plating solution, Hull cell test was conducted under the same conditions as above. The results of evaluation based on Hull cell test are shown in Table 1.

Examples 2~12 and Comparative Example 3

Plating solutions each comprising an aqueous solution and any of various dispersants and brighteners were prepared, the aqueous solution containing methanesulfonic acid and divalent tin salt and copper salt of the methanesulfonic acid as in Example 1. The plating solutions were then subjected to Hull cell test at an electric current of 2A for 5 minutes. For comparison, a plating solution containing neither brightener nor dispersant was prepared and then subjected to Hull cell test under the same conditions as above. The results of evaluation based on Hull cell test are shown in Table 1.

TABLE 1

| | Example | | | | | | | | | | | | Comparative Example | | |
|---|---|---|---|---|---|---|---|---|---|---|---|---|---|---|---|
| Component (g/L) | 1 | 2 | 3 | 4 | 5 | 6 | 7 | 8 | 9 | 10 | 11 | 12 | 1 | 2 | 3 |
| Tin methanesulfonate (as $Sn^{2+}$) | 30 | 30 | 30 | 30 | 30 | 30 | 30 | 30 | 30 | 30 | 30 | 30 | 30 | 30 | 30 |
| Copper methanesulfonate (as $Cu^{2+}$) | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 |
| Methanesulfonic acid | 200 | 200 | 200 | 200 | 200 | 200 | 200 | 200 | 200 | 200 | 200 | 200 | 200 | 200 | 200 |
| Polyoxyethylene nonyl phenyl ether | — | 10 | — | 10 | — | 10 | — | 10 | — | 10 | — | 10 | — | 10 | — |
| Polyoxyethylene dodecyl ether | 10 | — | 10 | — | 10 | — | 10 | — | 10 | — | 10 | — | 10 | — | — |
| Propylene glycol methyl ether | — | — | 1.5 | 1.5 | — | — | 1.5 | 1.5 | — | — | 1.5 | 1.5 | — | — | — |
| Dipropylene glycol methyl ether | 1.5 | 1.5 | — | — | 1.5 | 1.5 | — | — | 1.5 | 1.5 | — | — | 1.5 | 1.5 | — |
| Formaldehyde | 0.5 | — | 0.5 | — | 0.5 | — | 0.5 | — | 0.5 | — | 0.5 | — | — | — | — |
| Propionaldehyde | — | 0.5 | — | 0.5 | — | 0.5 | — | 0.5 | — | 0.5 | — | 0.5 | — | — | — |
| Salicylaldehyde | 0.2 | — | 0.2 | — | 0.2 | — | 0.2 | — | 0.2 | — | 0.2 | — | — | — | — |
| 1-Naphthaldehyde | — | 0.2 | — | 0.2 | — | 0.2 | — | 0.2 | — | 0.2 | — | 0.2 | — | — | — |
| Acetylacetone | 0.2 | — | 0.2 | — | 0.2 | — | 0.2 | — | 0.2 | — | 0.2 | — | — | — | — |
| Benzylideneacetone | — | 0.2 | — | 0.2 | — | 0.2 | — | 0.2 | — | 0.2 | — | 0.2 | — | — | — |
| Acrylic acid | 0.3 | 0.3 | 0.3 | 0.3 | — | — | — | — | 0.3 | 0.3 | 0.3 | 0.3 | — | — | — |
| Methacrylic acid | — | — | — | — | 0.5 | 0.5 | 0.5 | 0.5 | — | — | — | — | — | — | — |
| Catechol | 0.7 | 0.7 | 0.7 | 0.7 | 0.7 | 0.7 | 0.7 | 0.7 | — | — | — | — | 0.7 | 0.7 | 0.7 |
| Hydroquinone | — | — | — | — | — | — | — | — | 0.7 | 0.7 | 0.7 | 0.7 | — | — | — |

TABLE 1-continued

| | Example | | | | | | | | | | | | Comparative Example | | |
|---|---|---|---|---|---|---|---|---|---|---|---|---|---|---|---|
| Component (g/L) | 1 | 2 | 3 | 4 | 5 | 6 | 7 | 8 | 9 | 10 | 11 | 12 | 1 | 2 | 3 |
| Hull cell appearance | | | | | | | | | | | | | | | |
| High current portion | ○ | ○ | ○ | ○ | Δ | ○ | Δ | ○ | ○ | ○ | ○ | ○ | x | x | x |
| Medium current portion | ○ | ○ | ○ | ○ | ○ | ○ | ○ | ○ | ○ | ○ | ○ | ○ | x | x | x |
| Low current portion | ○ | ○ | ○ | ○ | ○ | ○ | Δ | ○ | ○ | ○ | ○ | ○ | x | x | x |

Hull cell appearance
○: bright
Δ: semi-bright
x: mat

According to the present invention, as is apparent from the above results, there were obtained tin/copper alloy plating films having a bright or semi-bright smooth appearance over an area from high to low electric current portion. In contrast therewith, the comparative tin/copper alloy plating films were mat.

What is claimed is:

1. A cyanide-free bright tin-copper alloy electroplating solution which comprises an aqueous solution comprising (i) an organosulfonic acid, (ii) a divalent tin salt of an organosulfonic acid, (iii) a divalent copper salt of an organosulfonic acid, (iv) a dispersant comprising at least two compounds selected from the group consisting of polyoxyethylene alkyl phenyl ethers, polyoxyethylene alkyl ethers, and alkylene glycol alkyl ethers, and (v) a brightener selected from the group consisting of aliphatic or aromatic aldehydes, aliphatic or aromatic ketones, aliphatic carboxylic acids and mixtures thereof.

2. The cyanide-free bright tin-copper alloy electroplating solution as set forth in claim 1, further comprising an antioxidant.

3. A process for plating a tin-copper alloy upon a substrate, said process comprising:

a. contacting the substrate with a plating solution comprising:

(i) organosulfonic acid;

(ii) divalent tin salt of an organosulfonic acid;

(iii) divalent copper salt of an organosulfonic acid;

(iv) dispersant comprising at least two compounds selected from the group consisting of polyoxyethylene alkyl phenyl ethers, polyoxyethylene alkyl ethers and alkylene glycol alkyl ethers; and (v) brightener selected from the group consisting of aliphatic or aromatic aldehydes, aliphatic or aromatic ketones, aliphatic carboxylic acids and mixtures thereof; and b. applying an electrical potential to the substrate thereby causing the substrate to become a cathode and causing a tin-copper alloy to plate upon said substrate;

wherein said plating solution is substantially free of cyanide.

4. A process according to claim 3, wherein the plating solution also comprises an antioxidant.

5. A process according to claim 3, wherein said brightener comprises at least two members selected from the group consisting of aliphatic and aromatic aldehydes, aliphatic and aromatic ketones, and aliphatic carboxylic acids.

6. A process according to claim 5, wherein the plating solution also comprises an antioxidant.

* * * * *